United States Patent [19]

Turner

[11] Patent Number: 4,761,097

[45] Date of Patent: Aug. 2, 1988

[54] SYSTEM FOR MATING AN INTEGRATED DECK WITH AN OFFSHORE SUBSTRUCTURE

[75] Inventor: J. Ward Turner, Houston, Tex.

[73] Assignee: Exxon Production Research Company, Houston, Tex.

[21] Appl. No.: 945,260

[22] Filed: Dec. 22, 1986

[51] Int. Cl.[4] ..... E02B 17/08; E02D 21/00; E02D 25/00

[52] U.S. Cl. ..... 405/204; 405/195; 405/203; 405/209

[58] Field of Search ..... 405/195–197, 405/202–210, 221, 224, 226, 223, 229

[56] References Cited

U.S. PATENT DOCUMENTS

| | | | |
|---|---|---|---|
| 3,852,969 | 12/1974 | Gibson et al. . | |
| 4,222,683 | 9/1980 | Schaloske et al. | 405/204 |
| 4,252,468 | 2/1981 | Blight | 405/204 |
| 4,431,345 | 2/1984 | Inoue | 405/204 |
| 4,436,454 | 3/1984 | Ninet et al. | 405/204 |
| 4,607,982 | 8/1986 | Brasted et al. | 405/204 |
| 4,655,641 | 4/1987 | Weyler | 405/204 |

FOREIGN PATENT DOCUMENTS

| | | | |
|---|---|---|---|
| 2609823 | 12/1976 | Fed. Rep. of Germany | 405/204 |

*Primary Examiner*—Randolph A. Reese
*Assistant Examiner*—John A. Ricci
*Attorney, Agent, or Firm*—Kenneth C. Johnson; Keith A. Bell

[57] ABSTRACT

A system for mating an integrated deck structure with an offshore substructure is provided. The system comprises a spud can attached to a leg of the integrated deck structure and a bin attached to a leg of the substructure for receiving the spud can. The bin contains a bed comprising a medium having variable stiffness and damping characteristics which is utilized to minimize the dynamic forces that occur between the integrated deck structure and the substructure during the mating procedure.

20 Claims, 2 Drawing Sheets

SYSTEM FOR MATING AN INTEGRATED DECK WITH AN OFFSHORE SUBSTRUCTURE

FIELD OF THE INVENTION

The present invention relates generally to offshore drilling and production apparatus and operations; more particularly, it relates to apparatus and methods for mating integrated deck structures with substructures.

BACKGROUND OF THE INVENTION

Integrated deck structures are prefabricated decks designed to be installed as a unit onto a substructure at an offshore location. These substructures provide a framework for anchoring the deck, and are generally either fixed or floating. Fixed substructures are attached to the ocean floor, typically by means of a gravity base or piled foundations. Floating substructures are sufficiently buoyant such that their own weight is carried by the buoyancy, and position is maintained by an anchoring system.

When mating an integrated deck structure with a substructure, the deck is usually transported to the substructure by means of a barge. For most applications, a single barge is used; however, in mounting deck structures onto single leg substructures such as those used in arctic climates, multiple barges may be required. Typically, the barge is moved into position proximate the substructure and ballasted to lower the integrated deck structure onto the substructure and transfer its load thereto. Once the integrated deck is in place and the load transferred to the substructure, the barge is disengaged and taken back to shore.

Many complications can arise during this mating procedure, due in large part to the relative motion between the deck and the substructure caused by ocean waves, currents and wind. This movement can cause the deck and the substructure to collide, resulting in appreciable damage to the equipment and unwanted delays to repair or replace any equipment so damaged. This movement also complicates the alignment of the deck with the substructure, which is necessary to insure a proper mating between the two.

Prior art solutions to the alignment problem primarily involve stabbing a smaller diameter leg, either on the deck or the substructure, into a corresponding larger diameter collar on the other component. This collar directs the smaller diameter leg into alignment once the leg is within the collar. This solution is satisfactory only in the respect that it does not require initial perfect placement of the deck and the substructure for proper alignment; however, the wind and water forces can still cause the aforementioned damaging collisions.

Prior art solutions to the collision problem primarily involve the use of a damping (shock absorbing) and/or cushioning (deformable spring) means to lessen the impact of these collisions. These prior art systems, however, suffer from many shortcomings. First, these systems do not readily allow for control over of the amount of cushioning and damping during the mating procedure, that is, these parameters are constant during the mating operation. Also, the prior art systems tend to utilize complex hydraulic and mechanical devices as aligning, cushioning, and damping means, thus complicating the mating procedure and increasing the risk of operator error, machine failure, and resultant equipment damage. The present invention is aimed at overcoming these shortcomings in an economical fashion.

SUMMARY OF THE INVENTION

In accordance with the present invention, there is provided a mating system and methods for its use in mating an integrated deck structure onto a substructure at an offshore location. The mating system, in its overall concept, comprises a load bearing spud can attached to the base of a leg on the integrated deck structure, a corresponding bin attached to a leg of the substructure for receiving the spud can, and a bed within the bin comprising a medium having variable stiffness and damping characteristics. This medium allows the integrated deck structure to move both vertically and laterally relative to the substructure during the initial stages of the mating procedure, while being able to carry the entire load of the integrated deck structure by adjusting the stiffness of the medium once the spud can is in place within the bin.

In the operation of the preferred mating system, the integrated deck structure is transported to the substructure by means of a barge. The barge is then ballasted as the beds within the bins are fluidized to lower their stiffness. As the barge is ballasted, the spud cans extend into the bins and the stiffness in the bed is gradually increased by withdrawing the fluid. Once the spud cans are in final placement within the bin and the desired portion of the load of the integrated deck structure is transferred from the barge to the substructure, the barge is disengaged from the integrated deck structure and returned to shore. The integrated deck structure and the substructure are then more precisely aligned by evacuating or otherwise removing the medium from the bin. After final alignment, the bin can be removed from the leg of the substructure and the spud can be welded thereto for additional support.

These and other features and advantages of the present invention will be more readily understood by those skilled in the art from a reading of the following detailed description with reference to the accompanying drawings.

DETAILED DESCRIPTION OF THE PREFERRED EMBODIMENT

Figure 1:
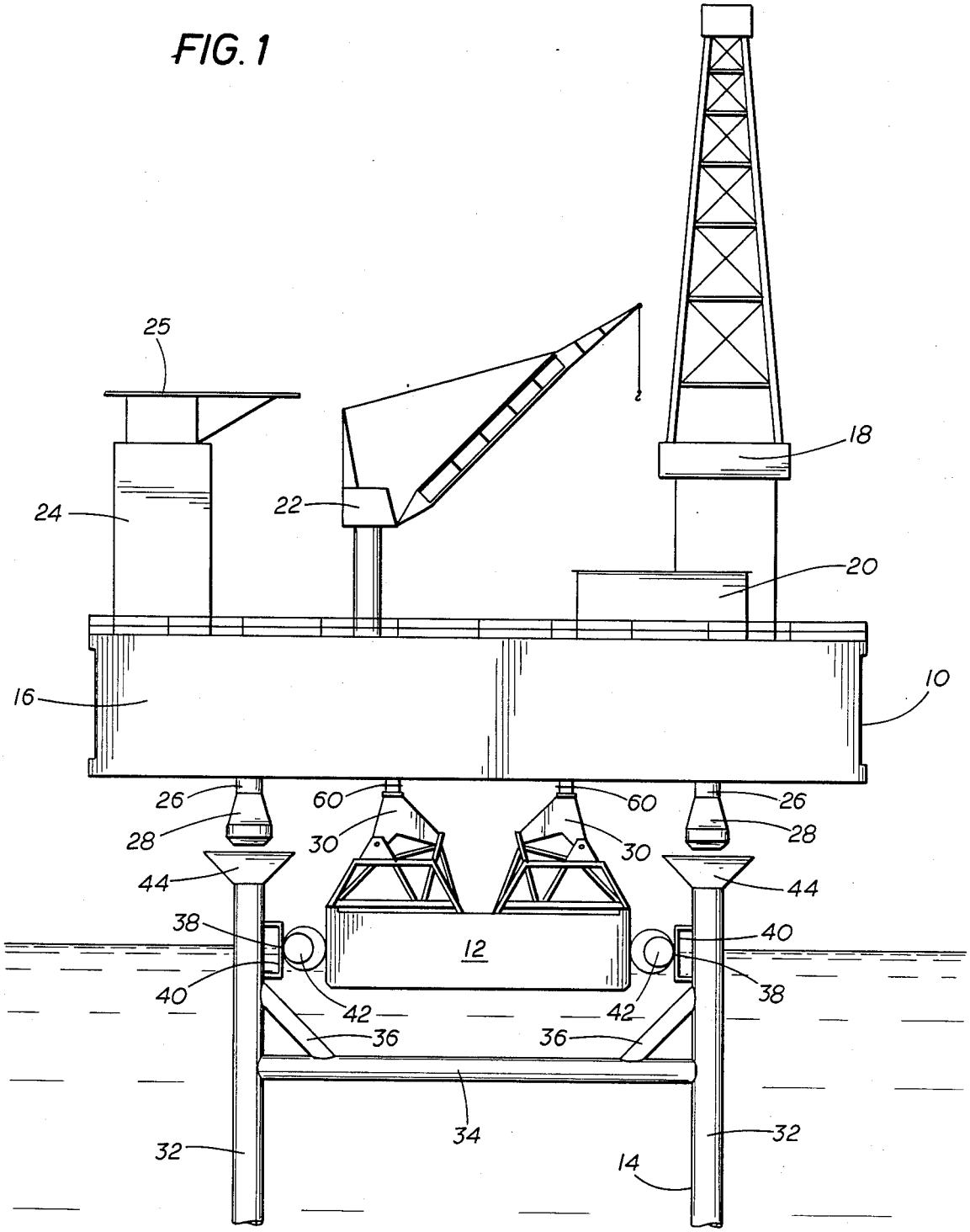
FIG. 1 is an illustration of an offshore mating operation in accordance with the present invention showing an integrated deck structure on a barge in place for mating with an offshore substructure.

Referring now to the drawings in more detail, particularly to FIG. 1, there is illustrated an offshore mating operation in accordance with the present invention. More particularly, FIG. 1 shows an integrated deck structure 10 on a barge 12 in place for mating with an offshore substructure 14.

Integrated deck structure 10 is preferably a prefabricated unit constructed onshore to be transported by barge 12 and mated at an offshore location with substructure 14. As depicted in FIG. 1, integrated deck structure 10 includes a platform deck 16 having a derrick 18, storage shed 20, crane 22 and quarters 24 with a helipad 25 mounted thereon.

Integrated deck structure 10 also has one or more downwardly extending legs 26 mounted underneath platform 16 with a spud can 28 attached to the base of each leg 26. Spud can 28 is provided as a load bearing member during the transfer of the load of integrated deck structure 10 to substructure 14 as detailed below.

Integrated deck structure 10 is initially mounted on barge 12 for transportation to offshore substructure 14. Barge 12 may be any suitable vehicle known to those skilled in the art for transporting integrated deck structure 10 to such an offshore location. As depicted in FIG. 1, barge 12 is of a conventional construction provided with drop block assemblies 30 for carrying integrated deck structure 10 to substructure 14. Integrated deck structure 10 is provided with load bearing pads 60 which rest on drop block assemblies 30. Once in place proximate substructure 14, barge 12 is ballasted to transfer the load of integrated deck structure 10 to substructure 14, drop block assemblies 30 are detached from load bearing pads 60 and barge 12 is returned to shore as detailed below.

Substructure 14 is provided as an offshore mount for integrated deck structure 10. Substructure 14 may be fixed or floating, and its general construction may be any one of a number of well known fixed or floating substructure arrangements. As shown in FIG. 1, substructure 14 comprises one or more upwardly extending legs 32 supported there-between by horizontal strut 34 and angular struts 36. Substructure 14 is also provided with a fender assembly 38 for use in positioning barge 12 during the mating operation. As shown in FIG. 1, fender assembly 38 comprises a truss 40 mounted on each of legs 32 to which a bumper 42 is attached. Bumper 42 can be of inflatable or other construction as necessary to position barge 12 in approximate alignment for the mating operation.

Figure 2:
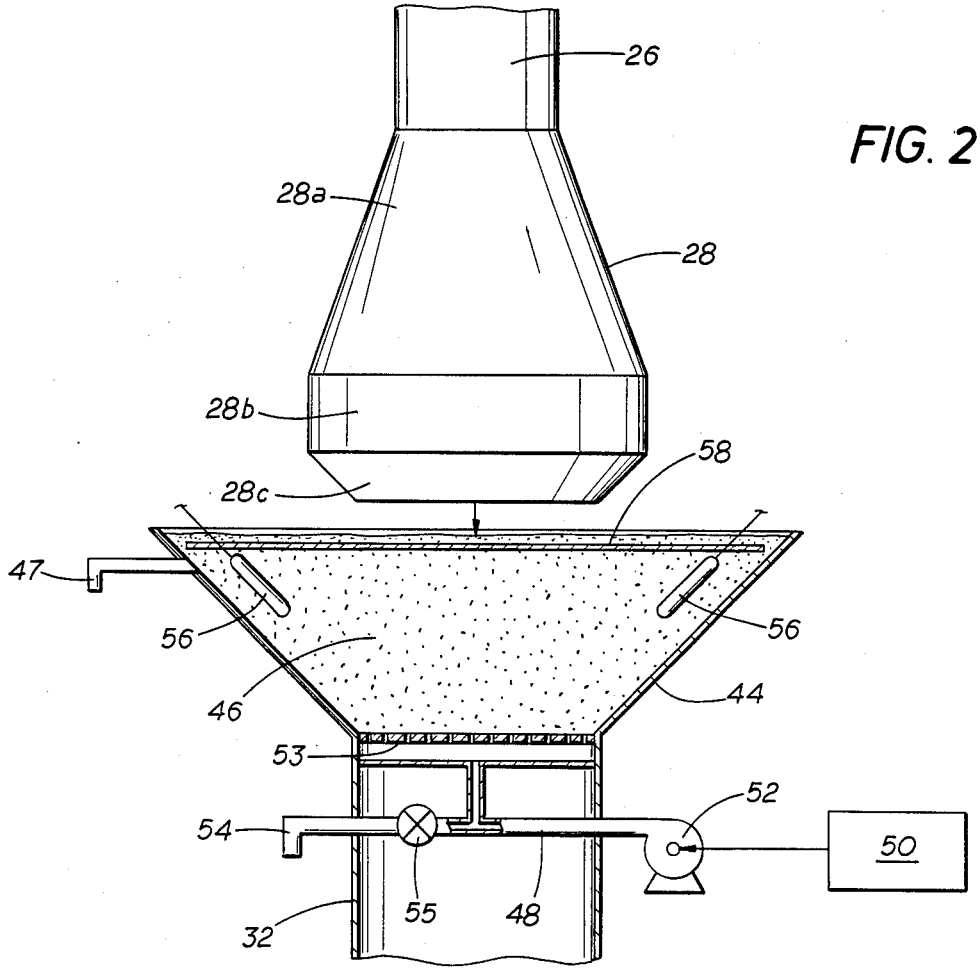
FIG. 2 is a cross-section of a mating system in accordance with the present invention for mating the integrated deck structure onto the offshore substructure, showing the system prior to the mating procedure.

Each mating leg 32 of substructure 14 is provided with a bin 44. Referring now to FIG. 2, bin 44 preferably comprises a hollow extension, more preferably a hollow frusto-conical extension, from the top of leg 32. Each bin 44 is designed to receive a corresponding spud can 28. The inner diameter of the top of bin 44 should be large enough to allow sufficient room for spud can 28 to enter and move within bin 44. The inner diameter at the bottom of bin 44 should correspond approximately to the outer diameter at the base of spud can 28 to facilitate alignment as detailed below.

Bin 44 is also utilized as a container for a bed 46 which comprises a medium having variable stiffness and damping characteristics which can be controlled and adjusted during the mating operation. In the initial stages of the mating procedure, the medium in bed 46 will have little or no stiffness, allowing spud can 28 to move freely within bed 46. This, in turn, allows integrated deck structure 10 to move relative to substructure 14 during these initial stages. Once spud can 28 is extended into bed 46, the stiffness of bed 46 is increased to carry more of the load of integrated deck structure 10. This increase in stiffness also results in an increase in the damping by bed 46 of the relative movement between integrated deck structure 10 and substructure 14. Once spud can 28 extends sufficiently into bin 44, the stiffness of bed 46 is increased so that bed 46 provides a solid base for the load bearing surfaces of spud can 28, thereby shifting the load of integrated deck structure 10 from barge 12 to substructure 14 as barge 12 is continuously being ballasted. Once the desired portion of the load has been shifted, barge 12 can be detached from integrated deck structure 10 using drop block assembly 30 and returned to shore, leaving integrated deck structure 10 mounted onto substructure 14.

Figure 3:
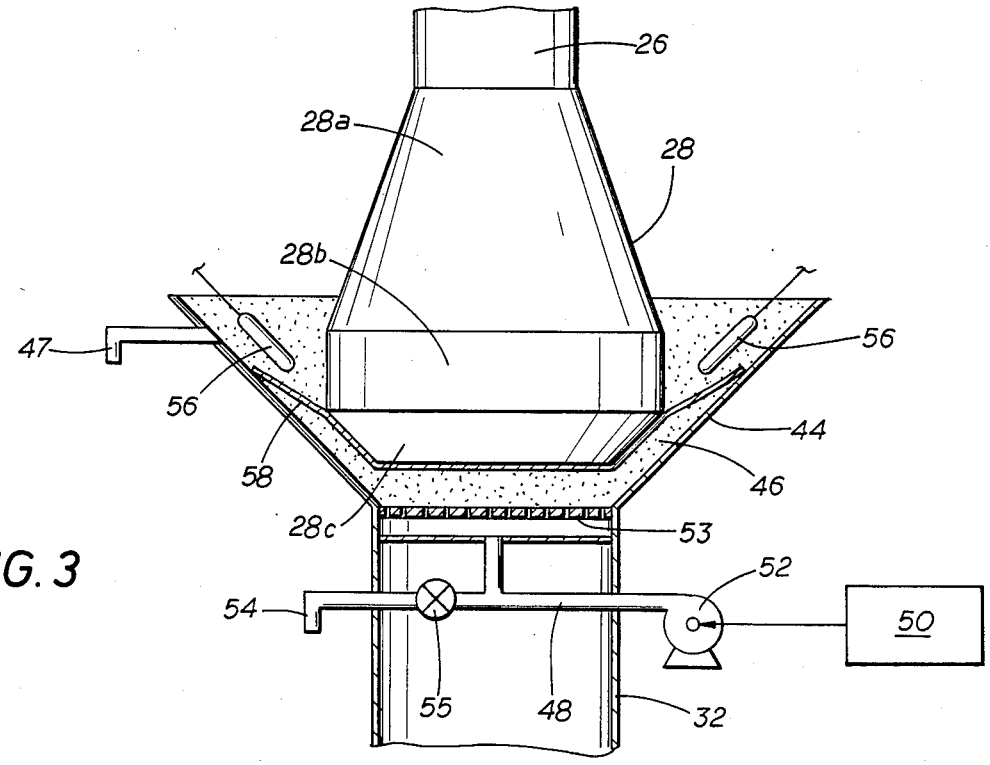
FIG. 3 is a cross-section of the mating system of FIG. 2 showing a leg of the integrated deck structure extending into the bin of a leg of the offshore substructure during the mating procedure.

In the preferred embodiment of the mating system as depicted in FIGS. 2 and 3, bed 46 comprises a medium which has a variable stiffness and damping characteristics in response to action of a fluid. An especially preferred medium is a granular material, most preferably sand or a sand/gravel mixture, which has a high stiffness when dry but little or no stiffness when fluidized. One particular advantage of sand is that the transition to and from high to low stiffness can be made almost instantaneously if desired, thereby providing a great amount of control over the transfer of the load of integrated deck structure 10 from barge 12 to substructure 14. Further, sand can normally be fluidized simply with water, in this case preferably seawater due to the offshore operation; therefore, this medium does not require special fluid reservoirs to be set up as part of the operation nor does it present special environmental problems. In certain cold climates a heat source (not shown) may be required to keep the fluid (water) and bed 46 in a fluid state.

It should be noted that the medium of bed 46 is not limited simply to soils fluidizable under the action of water or seawater. As an alternative, the medium of bed 46 could comprise a plastic or tar-like material fluidizable under the action of heat or a solvent. By removing the heat or solvent, the medium will return to its original, stiff condition. As another alternative, a liquid monomer may be polymerized through a chemical reaction to form a solid, high stiffness polymer. Although the use of the soil medium is preferred, one skilled in the art will be able to utilize these and other alternatives and choose the appropriate medium for bed 46 accordingly.

Referring again to the preferred embodiment as depicted in FIGS. 2 and 3, bed 46 is fluidized by a pump assembly 48 which utilizes a pump 52 to pump a fluid from fluid reservoir 50, through diffuser plate 53 and into bed 46, fluidizing the medium in bed 46 and decreasing its stiffness. Diffuser plate 53 is provided to evenly distribute the fluid from pump 52 into bed 46 to minimize channeling within the medium of bed 46. Pump assembly 48 also has a drain 54 for draining the fluid out of bed 46, and a valve 55 for controlling fluid flow out of drain 54 and, in turn, into and out of bed 46. Pump 52 may also be used to drain fluid from bed 46 by drawing the fluid therefrom. Bin 44 is provided with a drain 47 proximate the top of bed 46 to assist in draining excess fluids from bed 46.

Bed 46 may optionally be provided with one or more vibrators 56 and membrane 58. Vibrators 56 are placed within bed 46 to assist in the fluidizing process. Through various frequency and amplitude modulations as will be understood by those skilled in the art, vibrators 56 can both facilitate the fluidizing of bed 46 to "quick" type conditions, and the return to "stiff" conditions by varying the amount of vibration, thereby improving both response time and control over the fluidizing process. During strong vibrations, the resulting "quick" condition of bed 46 provides little or no resistance to spud can 28 as it moves bed 46 into bin 44. A reduction in the vibration allows the particles to settle causing bed 46 to stiffen and the load of deck structure 10 to be transferred.

Membrane 58 can be provided to assist fluid retention by bed 46 and modify the pore fluid pressures near the surface of the medium of bed 46. Membrane 58 can be either a partially permeable membrane such as, for example, canvas, an impermeable plastic membrane or any other membrane as will be recognized by those skilled in the art.

Spud can 28, as previously mentioned, is utilized as the load bearing member of integrated deck structure 10. As depicted in FIGS. 2 and 3, spud can 28 is an extended diameter portion of leg 26 of integrated deck structure 10. The diameter of spud can 28 must be sufficiently large to provide support for integrated deck structure 10 on bed 46, and prevent deck structure 10 from uncontrollably sinking into bed 46 during the mating procedure when bed 46 is in a stiff condition.

Spud can 28 more preferably comprises a frusto-conical section 28*a* extending from leg 26 into a substantially cylindrical mid-section 28*b*. The base 28*c* of spud can 28 has a beveled exterior surface of similar slope to the interior surface of bin 44 to facilitate alignment between legs 26 and 32 as detailed below. Spud can 28 may be constructed of any material known to those skilled in the art capable of supporting integrated deck structure 10 such as, for example, steel, concrete or steel-reinforced concrete.

In the mating operation, integrated deck structure 10 is initially mounted on barge 12 for transportation to substructure 14. Barge 12 is moved into position proximate legs 32 of substructure 14 with spud cans 28 in approximate vertical alignment with bins 44. Barge 12 is secured to the extent possible by bumpers 42 of fender assembly 38 and anchor lines (not shown) from barge 12 to substructure 14. Valve 55 of pump assembly 48 is then closed and pump 52 turned on. A fluid, preferably water, more preferably seawater, is pumped continuously through diffuser plate 53 into bed 46 causing the medium, preferably a granular soil such as sand or a sand/gravel mixture, to exhibit "quick" conditions. Excess water near the surface of bed 46 is removed via drain 47.

Barge 12 then begins ballasting to lower spud cans 28 into bins 44. Relative motion, both lateral and vertical, between spud cans 28 and bins 44 caused by ocean waves, currents and wind are accommodated by the "quick" condition of bed 46. As spud can 28 extends into bed 44, pump 52 is either gradually slowed and/or valve 55 opened causing the fluid flow rate into bed 46 to decrease. As the fluid flow rate decreases, bed 46 becomes stiffer and stronger due to the settling of the medium and drainage of fluid, and starts carrying the load from integrated deck structure 10. Concurrently the damping of bed 46 becomes greater, reducing the relative motion between deck structure 10 and substructure 14. As pump 52 is completely turned off and the fluid drains from bed 46 through drain 54 (pump 52 may also be utilized to draw fluid from bed 46 if desired), bed 46 exhibits increasing load carrying capacity and is able to thus carry the full load of integrated deck structure 10 if desired. It is preferred, however, that the entire load of integrated deck structure 10 not be transferred prior to the disengagement of barge 12. Once the desired portion of the load has been transferred, drop block assemblies 30 are disconnected from bearing surfaces 60 to transfer the remaining load of integrated deck structure 10 to substructure 14. Activation of the drop block assemblies 30 creates an immediate gap between substructure 14 and barge 12. This gap provides sufficient clearance to prevent barge 12 from colliding with substructure 14 under the heaving influence of wave action.

When bed 46 is provided with vibrators 56 and membrane 58, the setdown procedure is essentially the same except that the fluidity of bed 46 can be controlled by vibrators 56 in addition to or in lieu of fluid flow alone. For example, fluid can initially be pumped into bed 46 to saturate but not fluidize the medium therein. Vibrators 56 can then be activated causing the medium to exhibit "quick" conditions and minimal stiffness. These "quick" conditions result from the continual rearrangement of the soil particles and the breakdown of the soil framework caused by the vibrating of vibrators 56. Once spud can 28 is in place within bin 44, vibrators 56 can be slowed or stopped, increasing its stiffness and damping and its load carrying capacity. As before, once the desired portion of the load of integrated deck structure 10 is transferred to bed 46, barge 12 is disconnected from integrated deck structure 10 and returned to shore.

After the setdown procedure is complete, integrated deck structure 10 may not necessarily be properly aligned on substructure 14 since barge 12 generally cannot be moored rigidly enough during the setdown procedure to prevent motion between integrated deck structure 10 and substructure 14. To accommodate for this nonalignment, the receiving surface area of bin 44 is made larger than spud can 28. As a result, spud can 28 may be eccentric relative to leg 32 after setdown. To compensate for the nonalignment, the medium in bed 46 may be washed out or otherwise evacuated from bin 44 so that the base of spud can 28 rests on or is close to the base of bin 44. The contact of beveled edge 28c on spud can 28 with the interior sloped surface of bin 44 causes spud can 28 and leg 32 to align. Once integrated deck structure 10 is in place and aligned on substructure 14, bin 44 may be removed from leg 32 of substructure 14 and spud can 28 welded to leg 32 for additional support.

The mating system of the present invention provides a simple and relatively inexpensive, yet effective, means for mating integrated deck structures with offshore substructures. The design and construction of the components of the system is technically simple and low in cost, and does not involve complex hydraulic and mechanical systems. Further, such system is simple to operate. Even further, the mating system of the present invention allows for great flexibility of the stiffness and damping of the bed. By being able to control these stiffness and damping characteristics, the relative motion between the deck and substructure can be controlled and the likelihood and force of collisions between the two can be minimized.

Inasmuch as the present invention is subject to many variations, modifications and changes in detail, it is intended that all subject matter discussed above and shown in the accompanying drawings be interpreted as illustrative and not in a limiting sense. Such variations, modifications, and changes in detail are included within the scope of the present invention as defined by the following claims.

What I claim is:

1. A system for mating an integrated deck structure onto an offshore substructure, comprising:

a downwardly extending leg on said integrated deck structure;

a spud can mounted to the base of said downwardly extending leg;

a corresponding upwardly extending leg on said offshore substructure; and means mounted on said upwardly extending leg of said substructure for receiving said spud can of said downwardly extending leg, comprising:

a hollow bin mounted onto said upwardly extending leg;

a bed within said bin comprising a medium having variable stiffness and damping characteristics, said bed adapted to permit said spud can to penetrate at least part way into said medium; and means for varying the stiffness and damping characteristics of said medium as said spud can is penetrating into said medium.

2. The system of claim 1, wherein said bed comprises a medium having variable stiffness and damping characteristics in response to action of a fluid.

3. The system of claim 2, wherein said bed comprises a granular medium.

4. The system of claim 3, wherein said bed comprises sand.

5. The system of claim 3, wherein said bed comprises a sand/gravel mixture.

6. The system of claim 2, wherein said means for varying the stiffness and damping characteristics of said medium comprises means for fluidizing said medium of said bed.

7. The system of claim 6, wherein said means for fluidizing comprises:

pump means for pumping a fluid into and drawing fluid out of said bed; and drain means for draining fluid from said bed.

8. The system of claim 7, wherein said means for fluidizing further comprises a valve for controlling the fluid flow from said pump means into said bed, and into said drain means from said bed.

9. The system of claim 7, wherein said means for fluidizing further comprises a vibrator placed within said bed.

10. The system of claim 7, wherein said means for fluidizing further comprises a membrane placed proximate the surface of said bed to assist fluid retention within said bed and to modify the pore fluid pressures near said surface of said bed.

11. The system of claim 1, wherein said bin has a sloped interior surface and said spud can has a beveled exterior surface of a substantially similar slope to facilitate the alignment of said upwardly and downwardly extending legs during and subsequent to said spud can being received into said bin.

12. The system of claim 1, wherein said bin comprises a hollow, frusto-conical member.

13. A method for mating an integrated deck structure onto an offshore substructure, wherein said integrated deck structure has at least one downwardly extending leg with a spud can attached thereto, and wherein said substructure has at least one corresponding upwardly extending leg with a means for receiving said spud can mounted thereon, said means for receiving said spud can comprising a hollow bin mounted onto said upwardly extending leg, a bed within said bin comprising a medium having variable stiffness and damping characteristics, and means for varying the stiffness and damping characteristics of said medium, said method comprising the steps of:

transporting said integrated deck structure mounted on a barge to said substructure;

positioning said barge proximate said substructure whereby said spud can is in approximate alignment with said bin;

decreasing the stiffness of said bed;

lowering said integrated deck structure onto said substructure, whereby said spud can is received by said bin into said bed;

increasing the stiffness of said bed as said spud can is received into said bin to transfer a portion of the load of said integrated deck structure from said barge to said substructure and to dampen relative motion between said integrated deck structure and said substructure;

disengaging said barge from said integrated deck structure when the desired portion of said load of said integrated deck structure has been transferred to said substructure upon disengagement of said integrated deck structure from said barge means; and aligning said integrated deck structure with said substructure.

14. The method of claim 13, wherein said step of decreasing the stiffness of said bed comprises the step of fluidizing said bed.

15. The method of claim 14, wherein said step of fluidizing said bed comprises the step of pumping a fluid from a fluid reservoir into said bed.

16. The method of claim 15, wherein said step of fluidizing said bed further comprises the step of activating a vibrator placed within said bed.

17. The method of claim 14, wherein said step of increasing the stiffness of said bed comprises the step of draining fluid from said bed.

18. The method of claim 13, wherein said step of lowering said integrated deck structure onto said substructure comprises the step of ballasting said barge.

19. The method of claim 13, wherein said step of aligning said integrated deck structure with said substructure comprises the step of evacuating said medium of said bed from said bin, whereby said spud can settles into alignment with said bin as said medium is evacuated.

20. The method of claim 13, further comprising the steps of:

removing said bin from said upwardly extending leg subsequent to said alignment of said integrated deck structure with said substructure; and attaching said spud can to said upwardly extending leg.

* * * * *